US011037447B2

(12) United States Patent
Sentis Ros

(10) Patent No.: US 11,037,447 B2
(45) Date of Patent: Jun. 15, 2021

(54) PARKING CONTROL METHOD AND CORRESPONDING COMPUTER PROGRAM

(71) Applicant: SENTISROS, SLP, Les Franqueses del Vallès (ES)

(72) Inventor: Carles Sentis Ros, Les Franqueses del Vallès (ES)

(73) Assignee: SENTISROS, SLP, Les Franqueses del Vallès (ES)

( * ) Notice: Subject to any disclaimer, the term of this patent is extended or adjusted under 35 U.S.C. 154(b) by 0 days.

(21) Appl. No.: 16/639,813

(22) PCT Filed: Aug. 8, 2018

(86) PCT No.: PCT/EP2018/071510
§ 371 (c)(1),
(2) Date: Feb. 18, 2020

(87) PCT Pub. No.: WO2019/038087
PCT Pub. Date: Feb. 28, 2019

(65) Prior Publication Data

US 2020/0250979 A1 Aug. 6, 2020

(30) Foreign Application Priority Data

Aug. 21, 2017 (EP) ..... 17382579

(51) Int. Cl.
*G08G 1/00* (2006.01)
*G08G 1/14* (2006.01)

(52) U.S. Cl.
CPC ..... *G08G 1/146* (2013.01)

(58) Field of Classification Search
CPC ..... G08G 1/146; G07C 1/30; G07B 15/02
See application file for complete search history.

(56) References Cited

U.S. PATENT DOCUMENTS 5,351,187 A 9/1994 Hassett
2002/0085515 A1* 7/2002 Jaynes ..... H04W 4/021 370/329

(Continued)

FOREIGN PATENT DOCUMENTS

KR 10-2017-0037368 A 4/2017

OTHER PUBLICATIONS

International Search Report and Written Opinion issued in corresponding International Patent Application No. PCT/EP2018/071510, dated Oct. 23, 2018.

*Primary Examiner* — Phung Nguyen
(74) *Attorney, Agent, or Firm* — Morgan, Lewis & Bockius LLP

(57) ABSTRACT

Parking control method and corresponding computer program. For outdoor parking zones (100), each zone (100) with a beacon device (101) broadcasting a beacon signal (102) with a unique code. Taking part: a server (300) and vehicles (200) with a portable user device (210) and a vehicle code (201). Comprising the following steps: determining a parking start for a parking zone (100); sending to said server (300) a parking request (401); by said server (300), determining whether the request is acceptable with a maximum parking time and sending a replay; by said portable device (210), informing of said reply; by said server (300), registering said vehicle as parked in said parking zone (100); determining a parking end for the current parking zone (100);—sending to said server (300) a parking end request (404); and by said server (300), registering said vehicle code (201) as not parked.

32 Claims, 6 Drawing Sheets

(56) References Cited

U.S. PATENT DOCUMENTS

| | | | | |
|---|---|---|---|---|
| 2005/0099320 | A1* | 5/2005 | Nath | G08G 1/017 340/933 |
| 2007/0112621 | A1 | 5/2007 | Miller et al. | |
| 2015/0356498 | A1* | 12/2015 | Casanova | G07B 15/02 705/13 |
| 2016/0117866 | A1* | 4/2016 | Stancato | H04L 51/32 705/5 |
| 2016/0140846 | A1* | 5/2016 | Outwater | G08G 1/144 340/932.2 |
| 2017/0172016 | A1* | 6/2017 | Kang | G09F 9/33 |
| 2018/0128638 | A1* | 5/2018 | Lei | G06Q 20/145 |

* cited by examiner

PARKING CONTROL METHOD AND CORRESPONDING COMPUTER PROGRAM

FIELD OF THE INVENTION

The invention relates to the field of parking control for restricted parking zones. In said parking zones, there is space for parking one or more vehicles, and said vehicles can be parked therein for a maximum time. For example, for loading and unloading zones.

More specifically, the invention relates to a parking control method for at least one outdoor parking zone.

The invention also relates to a corresponding computer program.

STATE OF THE ART

In most cities, there are outdoor restricted parking zones, in which vehicles can park with restrictions. They are open zones, generally without entrances and/or exits where a control access can be installed. For many of these zones, there is a maximum parking time and, in some cases, it is required that the user parking the vehicle has some kind of permission which gives the user the possibility of parking in said zone. The user can, for example, be either a neighbour in the area, or a haulier.

To date, control for such zones has been carried out through systems based on the user visibly placing inside the vehicle a sign showing more or less irrefutably the time at which the user parked therein. A supervisor periodically checks the zone in order to verify that the vehicles have said sign and the maximum time has not been exceeded.

Applications are known, in which such signs comprise parking disks where the user registers the parking time. Said disks (or other like instruments) can be obtained, for example, from the local public administration, whereby it is possible to verify to some extent that the person parking in said zone has indeed the permission for parking.

However, such solutions are tedious since the user must make previous arrangements before using the system, which may require physically attend customer service facilities for picking up the identifying disk or other like instruments. Furthermore, such solutions have a problem difficult to solve: a user can go back to the vehicle and update the time in the disk, so that he can fraudulently increase the parking time. To prevent such a misuse, the supervisor must put additional efforts into controlling the allowed time for the vehicles, which results in a decreased efficiency and a high likelihood of error. Further, the user clock, the supervisor clock and the official clock which is used to count the time in the zone, may not be synchronized, which can create unfair scenarios for the users, and forces margins of error to be established which are enough to solve such problems, and this may end up increasing thereby the real time available for parking and create unfair scenarios.

Other known such signs consists of tickets validated in machines arranged to that end in the zone. Thus, time registering is performed by means of an external device controlled by the entity managing the parking zone, which makes modifying said registering more difficult. Such machines are, however, expensive, since they must be manufactured to be highly robust due to their exposure to adverse environmental conditions, among other things. Further, they require periodical maintenance for the operation, consumable replacement, such as ink or paper, connection management, power supply, etc. Also, being outdoors in zones which often lack of surveillance, they are subject to vandalism. Therefore, deploying and maintaining such solutions entail a considerable financial effort. Further, because of the above-mentioned financial reasons, and in order to maximize the room available for parking, it is not feasible to install one of such machines in every parking space, which forces the user to move away from the vehicle to the vending machine and go back to place the ticket in the vehicle. These operations are tedious and time-consuming, particularly for loading and unloading zones where hauliers usually have a very tight delivery or pick-up schedule, and any required extra time has a negative impact on efficiency.

It must be noted that the fact that the described method is associated with outdoor zones implies certain technical requirements such as, for example, need of environmental tolerance.

For these reasons, it is required a parking control which is inexpensive to install and maintain, robust, and which minimizes the time needed for the user both to park and to be able to start using the system. Also, it must be secure and flexible, hindering system misuse and making supervision operations easier.

DESCRIPTION OF THE INVENTION

The purpose of the invention is to provide a parking control method of the above-mentioned kind, which enables to solve the problems set forth above.

Such purpose is accomplished through a parking control method of the above-mentioned kind, characterized in that, in each zone of said at least one parking zone it is provided a beacon device configured to broadcast a beacon signal comprising a unique beacon code, and wherein the following also take part:

- a server;
- at least one vehicle; and
- for each vehicle of said at least one vehicle, a portable user device corresponding to said vehicle and which moves together with said vehicle, said portable user device being provided with:
  - processing means;
  - a user interface;
  - beacon signal receiving means;
  - wireless communication means; and
  - a unique vehicle code, associated with said vehicle;

wherein the method comprises the following steps:

(p1) By a portable user device which moves together with a vehicle and with a vehicle code, determining a parking start for a parking zone with a beacon code.

(p2) By said communication means of said portable user device, sending to said server a parking request comprising said vehicle code and said beacon code.

(p3) By said server, determining whether said parking request is acceptable.

(p4) If said parking request is not acceptable, by said server, sending a parking request reply comprising an indication that said parking request is not acceptable.

(p5) By said portable user device, informing through said user interface, that said request is not acceptable.

(p6) If said parking request is acceptable, by said server, further determining a maximum parking time and sending a parking request reply comprising an indication that said parking request is acceptable and said maximum parking time.

(p7) By said portable user device, informing, through said user interface, that said request is acceptable and said maximum parking time.

(p8) By said server, registering said vehicle code as parked in said parking zone corresponding to said beacon code and a parking start time for said vehicle code, and determining said parking zone as a current parking zone.

(p9) By said portable user device, determining a parking end for said current parking zone.

(p10) By said communication means of said portable user device, sending to said server a parking end request comprising said vehicle code.

(p11) By said server, registering said vehicle code as not parked.

Said portable user device comprises preferably a smart phone, other preferable form being a device provided in the vehicle itself, for example, in the case of so-called smart vehicles. In these examples, at present, the most common wireless communication means comprise telephone data networks, for example, 3G or 4G networks. Currently, these data networks have a wide territorial coverage available, especially within cities, which make them particularly advantageous for data transmission without requiring an infrastructure dedicated to that purpose to be installed. Data transmission rates for said networks allow real-time streaming of audio, and even video, for which reason any application with lower transfer rate requirements is possible. However, using them for indoor zones is complicated, since the signal penetration into buildings, and especially underground, is limited. Thus, solutions based on telephone data networks are a preferred form for outdoor parking zones, since they obviate the need for a dedicated infrastructure while allowing data transmission rates which are high enough. Also, depending on the type of the portable device, the user interface may comprise different components, with non-exclusive examples being a touch screen for visual interaction, or a speaker and microphone, for voice interaction, or a combination of said components.

In this way, each parking zone is identified by a beacon device, which will also be referred to as merely beacon hereinafter. This beacon broadcasts a signal with an identifying code. This beacon code is unique in the system, so that there are not two beacons with equal beacon codes in the system. Therefore, there are not two parking zones identified by the same beacon code either. As for the beacon, it is a very simple device which only needs to broadcast a signal. Indeed, in the described method, complexity is distributed between the portable user device and the server. As for the server, it is in charge of verifying the parking conditions for a vehicle and a zone, and whether it is acceptable for said vehicle to park in said parking zone identified by a beacon code. Thus, if the request is not acceptable, parking is not allowed, while, if it is acceptable, parking is allowed and parking conditions are obtained, particularly maximum allowed time for parking. The server can use different data for determining whether the request is acceptable or not. For example, it can determine whether the vehicle associated with the vehicle code is allowed to use the parking zone corresponding to the request. Also, for zones with a limited number of parking spaces where there are no more free spaces left, the server can reject the requests until any of those spaces is cleared. This allows a high flexibility and a zone control which can be adapted to the environmental conditions. In the context of this document, although reference is made to a server for sake of brevity, a person skilled in the art will understand, in fact, that the particular implementation can make use of different solutions widely known in the state of the art, such as using different servers for different functions, one or more server clusters, whether virtualized or physical, servers in the so-called cloud computing services, etc., just to name a few common non-exclusive examples. Generally, although not described herein, the servers comprise processing means, communication interface and data storing means, such as hard disk drives or optical drives. Use of database services to store the system information is also common in the art. The present document will obviate those implementation details for the sake of clarity and brevity, since they are usually applied. In particular, the server has means for managing and establishing the system configuration, for example, saving associations between beacon devices and parking zones, coordinates for each beacon device, parking conditions for each zone, etc. Said management means, known in the art as back-office, are often based on a user interface which allows a user to manage the different elements, usually by storing those data in a database. Also, preferably, it is common for a server to reply with an acknowledgement message, when said server receives a request from a portable user device, at least for those requests not having an explicit reply message associated. This allows to determine, by the user, that the request has been received, and to strengthen control over possible transmission errors.

In the described solution, it is not required for complex machines to be present in the parking zones. It is not required either for the beacon device to receive communications from the portable user device, i.e., the beacon device is broadcasting a signal but does not need to receive communications or to process information. This has the advantage of a highly reduced general cost, both in the installation phase and for maintenance. Further, the beacons being very simple devices, they often have very low energy requirements, which allow implementation thereof with batteries having a lifetime of some years. This has the added advantage that it is not necessary any kind of connection with the electrical grid, with the beacons being able to be installed thereby in the most convenient place, preferably away from vandalism. In particular, in a preferred embodiment, each of said parking zones comprises an informative sign and said beacon device provided in said parking zone is provided on said informative sign. Generally, common informative signs are manufactured from metal material, and anchored to a post or the like. They usually give information to a user in the parking zone and about the general conditions of the facilities. In these examples, the informative sign may also signal how to use the method, in particular, how to access the method from the portable user device. In this way, the beacon device is environmentally isolated and out of sight, which deters vandalism. Also, system deployment is made easier by installing the beacon in conjunction with the informative sign, minimizing the likelihood of error by the operator carrying out the installation. Preferably, said beacon is provided in an internal housing provided in said informative sign. Preferably, on the upper rear portion. Thus, the beacon device is highly protected against the environment, in relation with both environmental conditions and vandalism. Preferably, said internal housing has orifices arranged to allow said beacon signal to be outputted, this being especially advantageous when said internal housing is manufactured from metal, which otherwise would block the signal. In a further alternative embodiment, said sign is provided with a sealed case, in particular with at least a sealing degree IP56 according to the IEC 60529 standard, said sealed case is removably attached to said informative sign through attaching means, particularly on the rear portion of said sign, and preferably, to the upper portion thereof, in order to locate it away from the ground and prevent vandalism. Said beacon device is provided in said sealed case. This allows making maintenance operations easier, when the beacon or its internal battery needs to be replaced. It also enables using informative signs already available, or with an existing manufacturing design. For this reason, it is not required an added cost for the deployment if the signs are available, for example, for a previous parking control system. Further, it is possible to select the material from which said sealed case is manufactured, so that it does not block the beacon signal.

On the other hand, location through beacons instead of methods which are only based on satellite location systems, for example, the Global Positioning System, GPS, has the advantage of providing a better precision for discriminating the distance to an actual parking zone. This is especially significant in urban environments where echoes caused by buildings entail a decreased location precision for satellite location based systems. This lack of precision may also result in the parking zone, where the vehicle is physically located to be confused with another nearby zone.

The vehicle code, which preferably comprises the plate number, is stored in the device in a previous step, for example, by means of the user interface. The fact of using the plate number makes it easier to visually check the parked vehicles.

If a parking zone is very large, a person skilled in the art will understand that it may be required to choose strategies such as dividing said zone into several sub-zones, or provide said zone with more than one beacon device. In either case, for a beacon device with a given beacon code, it is established a relationship, for example, by using the back-office in said server, which allows determining the parking zone to which each beacon code pertains.

Based on the invention as defined in the main claim, preferred embodiments are provided and the features thereof can be found in the dependent claims.

Preferably, each of said beacon devices comprises a Bluetooth Low Energy, BLE, device. Such devices have a very low power consumption, which allows maintenance related replacement to be carried out after a few years. Also, there is a significant support in the current scene of smart phones, and other portable devices with protocols such as those corresponding to the trade names iBeacon or Eddystone.

Preferably, said beacon code comprises a programmable identifying code. This allows discriminating, by the portable user device of the customer, whether the beacon pertains to the system, for example, said programmable identifying code may be a system identification name. Preferably, said beacon code further comprises an auxiliary programmable identifying code, which comprises a serial number of the beacon device, a date of manufacture and an expected expiry date. These informative elements allow the easy identification of the beacon features, even if there has been a data loss in the back-office system. They also provide a second authentication level that the beacon corresponds to the system. A person skilled in the art will understand that the whole information of said beacon code may be transmitted in different places of the beacon signal. For example, if a protocol iBeacon or Eddystone is used, said beacon code may comprise the programmable identifying code in the field for the device name, and in the auxiliary programmable identifying code in the UUID field.

Preferably, said beacon code comprises a media access control, MAC, address. This data can easily be obtained in most communication protocols, even in old devices, which increases compatibility with different user devices. By way of non-limiting example, various devices have Bluetooth connections available, even though they do not implement BLE protocols of the above-mentioned iBeacon or Eddystone type. In these cases, upon receiving the beacon signal by the portable user device the MAC address is received, which is enough to identify the beacon device. Furthermore, in this example, if said beacon code comprises the programmable identifier with the beacon device name previously described, an old portable user device can also discriminate the beacons in the system. Indeed, the name of the beacon device in this example is transmitted on the Bluetooth connection, being accessible thereby to those devices which are Bluetooth capable, even if they do not implement BLE protocols.

Preferably, the method also comprises a clock synchronization step between said portable user device and said server. This clock synchronization sets the clock of the portable user device or determines the difference between the clock of said device and the clock of said server. This allows to avoid race conditions in which requests and replies are counted in different time bases, which could give rise to inconsistencies within the system. By setting a general clock for the whole system, such problems are avoided to a large extent.

Preferably, said maximum parking time is fixed, which makes the system management easier. In an alternative embodiment, said maximum parking time is, however, variable depending on at least some of the parameters from the list consisting of: beacon code, vehicle code, user code, date and time. This allows the method to be able to establish different maximum parking times for adaptation, for example, according to the traffic needs in the zone, opening business hours, user or vehicle profiles, etc. The person skilled in the art will understand that the maximum time and the parking conditions may not vary directly in relation with the above parameters. Thus, the server, for example, can use said parameters to obtain data which, in turn, may be used for determining said maximum time. By way of example, the vehicle code can be used to obtain an indication for the consumption and pollution features of said vehicle, and utilize said indication to derive the maximum time. This results in an advantageous way of encouraging the use of low consumption and low pollution vehicles, allowing for longer parking times for such vehicles.

Preferably, said parking request also comprises a user code. In this way, a user may have various vehicles and the server can utilize the user profile to determine said maximum parking time. This is especially advantageous, for example, for hauliers who are in charge of various vehicles, or for companies having a fleet of vehicles shared by various hauliers as well. By including a code identifying the user, the parking conditions can be determined by said user and not only by each vehicle. Also, by including the user code it is possible for a user to access only to the parking information for the vehicles he is using. For example, in a case in which the same vehicle is shared by two users, the parking information for the vehicle will be received only by that user who is utilizing it, at his/her portable user device. The person skilled in the art will understand that the user code information is determined in the device in a previous step, for example, through a user login method in the server, as it is known in the art. In a preferred embodiment, the user code also comprises information relative to the portable user device, which increases security and prevents an impostor from pretending to be the user in case the former has got the latter's login information.

Preferably, the method comprises between said points (p7) and (p8) the following additional steps:

by said portable user device, requesting a parking start confirmation through said user interface;

if said parking start confirmation is received, sending to said server a parking start request.

Thus, the method offers the user the option to confirm that, in effect, he/she wants to start the vehicle parking. Preferably, said device also informs through said user interface about current parking conditions, for example, the maximum parking time. Thus, this additional confirmation step allows the user to have the option to check and accept the parking conditions for said parking zone, which is especially advantageous when said conditions are variable depending on parameters, such as date and time, user profile, zone, vehicle features, what is the vehicle used for, etc. A person skilled in the art will understand that the reply by the server in point (p8) corresponds in this case to the parking start request.

Preferably, said point (p1) comprises the following steps:

receiving by said user interface a parking start command;

receiving by said beacon signal receiving means, a beacon code list;

determining a closest beacon code as the beacon code of said beacon code list whose beacon device is the closest one;

informing through said user interface of the parking zone corresponding to said closest beacon code;

receiving through said user interface a selection of a parking zone; and determining said parking start for said received parking zone.

Therefore, in this embodiment, when the user wants to start the parking, the device receives, through the beacon signal receiving means, the close beacon signals with their respective beacon codes. The device determines, from the received signals, which beacon device is the closest one and communicates this to the user, showing the corresponding parking zone. Alternatively, the device can display a list where the parking zones are shown whose beacon devices are the closest ones, for example, in ascending distance order. Then, the user confirms the zone. In case that a list is shown, the user can choose a zone not corresponding to that determined as the closest one. The method thus described makes usability easier for the user and increases convenience thereof, since it receives an automatic indication of the one or more parking zones which are the closest ones. It is not required thereby for the user to manually enter information in the portable user device, such as, for example, a zone code or an address. Indeed, the device automatically informs of the closest zone. For the sake of clarity, the method is not described in the case that close beacon signals are not received, although the method, for this case, uses preferably device geolocation where available.

Preferably, said step for determining the closest beacon code as the beacon code of said beacon code list whose beacon device is the closest one comprises:

receiving each beacon code of said beacon code list through a corresponding beacon signal having a receiving power; and determining the closest beacon code as the beacon code whose beacon signal has the highest receiving power.

Thus, the determination of the distance is carried out indirectly from the received power of the beacon signal in the portable user device. Preferably, every beacon device in the system emits with the same power, which makes determination thereof easier. In a case where different beacons emit with different powers, in order to determine the relative distance between them, the portable user device must be able to determine the emitting power of each beacon, so that it can weigh compared powers for determining the distances. Such emitting power, as well as further information which may be required to be known by the portable user device in relation with the beacons, can be obtained through different methods, with non-exclusive examples thereof being information downloadable from the server or information held in the beacon signal. The skilled in the art will understand that the indirect distance determination by measuring the receiving power may be subject to errors due, for example, to environmental conditions, rain, presence of obstructions or the like.

Preferably, said point (p1) comprises the following steps:

determining when said beacon signal receiving means start detecting a beacon signal with a beacon code of a beacon device;

determining whether said receiving means detect said beacon signal with said beacon code during a time window longer than a start threshold time; and in the affirmative, determining said parking start for a parking zone associated with said beacon code.

Thus, the method allows, when the vehicle is stopped for a start threshold time in a parking zone, the automatic start of the parking request sequence. This results in a reduced need for user interaction, which increases user comfort. Preferably, said start threshold time is 60 seconds, being a time long enough to prevent undesired starts caused, for example, by traffic conditions.

Preferably, detecting a beacon signal comprises receiving a beacon signal which meets a validation criterion, such that if said beacon signal does not meet said validation criterion, said beacon signal is not deemed detected. This has a number of advantages. First, distant device signals can be discarded, resulting thereby in an easier user interaction. Secondly, information held in the beacon signal itself may be used to discard those beacon devices not pertaining to the system. For example, a beacon identifying code following a pre-set format can be used and those codes which are not according said format can be discarded. Preferably, the validation criterion is a combination of the above described power and identifying format criteria, although different criteria which are advantageous can be provided.

Preferably, said beacon signal receiving means receive said beacon signal with a receiving power and said validation criterion comprises said receiving power exceeding a power threshold. Preferably, said power threshold is −100 dBm. Those beacon signals received under said threshold are thereby discarded and not deemed detected. In this way, the list of close beacons is limited, and also, those beacons received by the device and which could give rise to errors o confusion by the user, due to phenomena, such as wave transmission or reflections, are filtered out.

Preferably, prior to determining a parking start for a parking zone associated with said beacon code, said portable user device asks for a confirmation through said user interface. This allows preventing false parking starts caused, for example, by heavy traffic conditions, traffic lights or situations wherein the vehicle stops near a parking zone but without really parking therein.

Preferably, said step (p9) comprises receiving, through said user interface, a parking end command. This allows the user to be able to decide for himself when the parking ends.

In an alternative embodiment, said step (p9) comprises the following steps:

determining when said portable user device is located at a distance from said current parking zone greater than the threshold distance; and in the affirmative, determining said parking end for said current parking zone.

Thus, it is not required an express interaction by the user but the method is able to automatically determine a parking end. This allows a more dynamic performance for the system and increases both convenience and efficiency. Also, it prevents a situation in which the end of the parking is not registered by the user. Indeed, the user can simply remove the vehicle from the parking zone, and, upon moving away from said zone, the parking end is automatically determined. Those skilled in the art will understand that the method may allow different non-exclusive options, in particular, either the above-described manual method or the method herein described. In a preferred embodiment, determining the distance is carried out using the received power of the beacon signal, as previously described.

Preferably, prior to determining said parking end, said portable user device requests a parking end confirmation through said user interface. This allows preventing an undesired parking end. This is especially advantageous in case that the portable user device is a mobile phone or a device carried by the user. Thus, in these cases, when the user leaves the vehicle, for example, for delivering or picking up any goods, the device may end up determining it is located at a greater distance, when actually the vehicle did not move.

In a preferred embodiment, determining when said portable user device is located at a distance from said current parking zone greater than a threshold distance comprises:

determining a location for said beacon device of said current parking zone;

determining a location for said portable user device, preferably through a geolocation means provided in said portable user device;

determining a separation distance between said location of said beacon device and said location of said portable user device; and determining whether said separation distance is greater than said threshold distance.

It is, thus, possible to determine the distance between the portable user device and the beacon through geolocation, for example, using GPS systems. For this purpose, the portable user device must be able to determine said beacon position, which can be carried out by different methods. It can be performed through requests to the server o through information transmitted on the beacon signal, as non-exclusive examples. Those skilled in the art will understand that said threshold distance may be either the same for all of the zones or different for each zone or beacon. The latter is especially advantageous where zones are present which have very distinct features, for example, with respect to extension, location or environmental conditions.

In an alternative embodiment, determining when said portable user device is located at a distance from said current parking zone greater than a threshold distance comprises:

determining when said beacon signal receiving means start detecting another beacon signal with another beacon code of another beacon device;

determining whether said another beacon device meets a remoteness criterion with respect to said current parking zone; and in the affirmative, determining that said portable user device is located at a distance from said parking zone which is greater than said threshold distance.

The detection of other beacons of the system is used thereby to determine the movement indicating the parking end. Thus, it is not necessary to use geolocation means which, as already pointed out, can be inaccurate in urban areas, and can also require an energy consumption which may result in a decreased operational autonomy for the portable user device. In this case, the term detection may denote not only completing the reception of a signal but the latter meeting some validation criterion, for example, on the power or beacon code format, as previously has been described above.

Preferably, said remoteness criterion comprises any of the list consisting of:

said another beacon code is not included in a list of near codes; or said another beacon code is included in a list of distant codes.

These are simple options for the portable user device, which reduces the likelihood of error. In the context of this document, said lists are referred to as white lists and black lists, respectively. The device must have the information of these white or black lists, for example, by periodically downloading them from the server, upon starting up the device or in the parking phase. The latter option is particularly advantageous since it results in less data traffic between the portable user device and the server.

In a preferred embodiment of the method, at least a supervisor also takes part and the same is provided with a portable supervisor device provided with:

processing means;

a user interface;

beacon signal receiving means; and wireless communication means;

wherein the method comprises the following additional steps:

(s1) by a portable supervisor device, determining a parking zone with a beacon code;

(s2) by said communication means of said portable supervisor device, sending to said server an information request comprising said beacon code;

(s3) by said server, determining vehicle codes corresponding to vehicles registered as parked in said parking zone, and for each one of said registered vehicle codes, determining a remaining parking time or an exceeded parking time;

(s4) by said server, sending to said communication means of portable supervisor device a reply to an information request, comprising an information list with said vehicle codes and, for each one of said vehicle codes, said remaining parking time or said exceeded parking time; and (s5) by said portable supervisor device, informing of said information list through said user interface.

In the context of this document, a supervisor is understood to be a person responsible for verifying that the parked vehicles are registered in the system and not exceeding the maximum time. The portable supervisor device may be the same kind as the portable user device or a different kind, for example, a smart mobile phone. In this way, the supervisor may efficiently verify that vehicles parked in a zone are correctly registered and within the maximum parking time. This is accomplished through the information registered in the server in the above described method steps. Preferably, the vehicle code comprises the plate number, with the supervisor being able thus to relate the portable supervisor device information to the visual information within reach in the parking zone. The same purpose can be accomplished in the case of other indications present in the vehicle, such as tags stuck to the inner side of the windscreen with an identifying code which can be seen from outside. In some embodiments, the received information also comprises pictures of the parked vehicles, making the supervisor method still easier.

Preferably, said point (s1) comprises one of:

receiving, through said user interface, a parking zone selection command;

determining a parking zone whose beacon device is located closest to the portable supervisor device.

Thus, the supervisor can manually choose the parking zone to be verified, which allows him to receive information even from those vehicles parked in distant zones. Also, automatically determining close zones allows receiving the information automatedly without requiring express commands by the supervisor. Said determination can be carried out equivalently to the optional embodiments described above in the case where the user is involved.

The invention also refers to a computer program containing program code instructions which, upon being executed by a portable user device which moves together with a vehicle, said portable user device being provided with:

processing means;

a user interface;

beacon signal receiving means, configured for receiving beacon signals containing unique beacon codes, from beacon devices provided in outdoor parking zones;

wireless communication means, configured for establishing a communication with a server; and a unique vehicle code, associated with said vehicle;

perform operations carrying out the following method:

(a1) determining a parking start for a parking zone with a beacon code;

(a2) by said communication means, sending to said server a parking request comprising said vehicle code and said beacon code;

(a3) by said communication means, receiving an indication indicating whether said parking request is acceptable, and in the affirmative, receiving a maximum parking time;

(a4) informing, through said user interface, about whether said parking request is acceptable and, in the affirmative, about said maximum parking time, and determining said parking zone as a current parking zone;

(a5) by said portable user device, determining a parking end for said current parking zone; and (a6) by said communication means of said portable user device, sending to said server a parking end request comprising said vehicle code.

For the sake of brevity, the description of elements and technical effects equivalent to those described above herein will not be repeated.

Preferably, said parking request also comprises a user code.

Preferably, it comprises the following additional steps when the parking request is acceptable:

requesting a parking start confirmation through said user interface;

if said parking start confirmation is received, sending to said server a parking start request.

Preferably, said point (a1) comprises the following steps:

receiving, through said user interface, a parking start command;

receiving through said beacon signal receiving means, a beacon code list;

determining a closest beacon code as the beacon code from said beacon code list whose beacon device is the closest one;

informing, through said user interface, of the parking zone corresponding to said closest beacon code;

receiving, through said user interface, a selection of a parking zone; and determining said parking start for said received parking zone.

Preferably, said step for determining the closest beacon code as the beacon code of said beacon code list whose beacon device is the closest one comprises:

receiving each beacon code of said beacon code list through a corresponding beacon signal having a receiving power; and determining the closest beacon code as the beacon code whose beacon signal has the highest receiving power.

Preferably, said point (a1) comprises the following steps:

determining when said beacon signal receiving means start detecting a beacon signal with a beacon code of a beacon device;

determining whether said receiving means detect said beacon signal with said beacon code during a time window longer than a start threshold time; and in the affirmative, determining said parking start for a parking zone associated with said beacon code.

Preferably, detecting a beacon signal comprises receiving a beacon signal which meets a validation criterion, such that if said beacon signal does not meet said validation criterion, said beacon signal is not deemed detected.

Preferably, said beacon signal receiving means receive said beacon signal with a receiving power, and wherein said validation criterion comprises said receiving power exceeding a power threshold.

Preferably, prior to determining a parking start for a parking zone associated with said beacon code, said portable user device asks for a confirmation through said user interface.

Preferably, said step (a5) comprises receiving, through said user interface, a parking end command.

Preferably, said step (a5) comprises the following steps:

determining when said portable user device is located at a distance from said current parking zone greater than a threshold distance; and in the affirmative, determining said parking end for said current parking zone.

Preferably, prior to determining said parking end, said portable user device requests a parking end confirmation through said user interface.

Preferably, determining when said portable user device is located at a distance from said current parking zone greater than a threshold distance comprises:

determining a location for said beacon device of said current parking zone;

determining a location for said portable user device, preferably through a geolocation means provided in said portable user device;

determining the separation distance between said location of said beacon device and said location of said portable user device; and determining whether said separation distance is greater than said threshold distance.

Preferably, determining when said portable user device is located at a distance from said current parking zone greater than a threshold distance comprises:

determining when said beacon signal receiving means start detecting another beacon signal with another beacon code of another beacon device;

determining whether said another beacon device meets a remoteness criterion with respect to said current parking zone; and in the affirmative, determining that said portable user device is located at a distance from said parking zone which is greater than said threshold distance.

Preferably, said remoteness criterion comprises any of the list consisting of:

said another beacon code is not included in a list of near codes; or said another beacon code is included in a list of distant codes.

The invention is also related to a computer-readable recording medium containing a computer program as described above.

The invention is also related to the above described computer program, carried by a carrier wave.

The invention comprises other detail characteristics shown in the detailed description of an embodiment of the invention and in the accompanying figures.

BRIEF DESCRIPTION OF THE DRAWINGS

Advantages and characteristics of the invention will be more apparent from the following description, wherein preferred embodiments of the invention are set forth without limitation to the scope of the main claim, and with reference to the figures.

DETAILED DESCRIPTION OF EMBODIMENTS OF THE INVENTION

Figure 1:
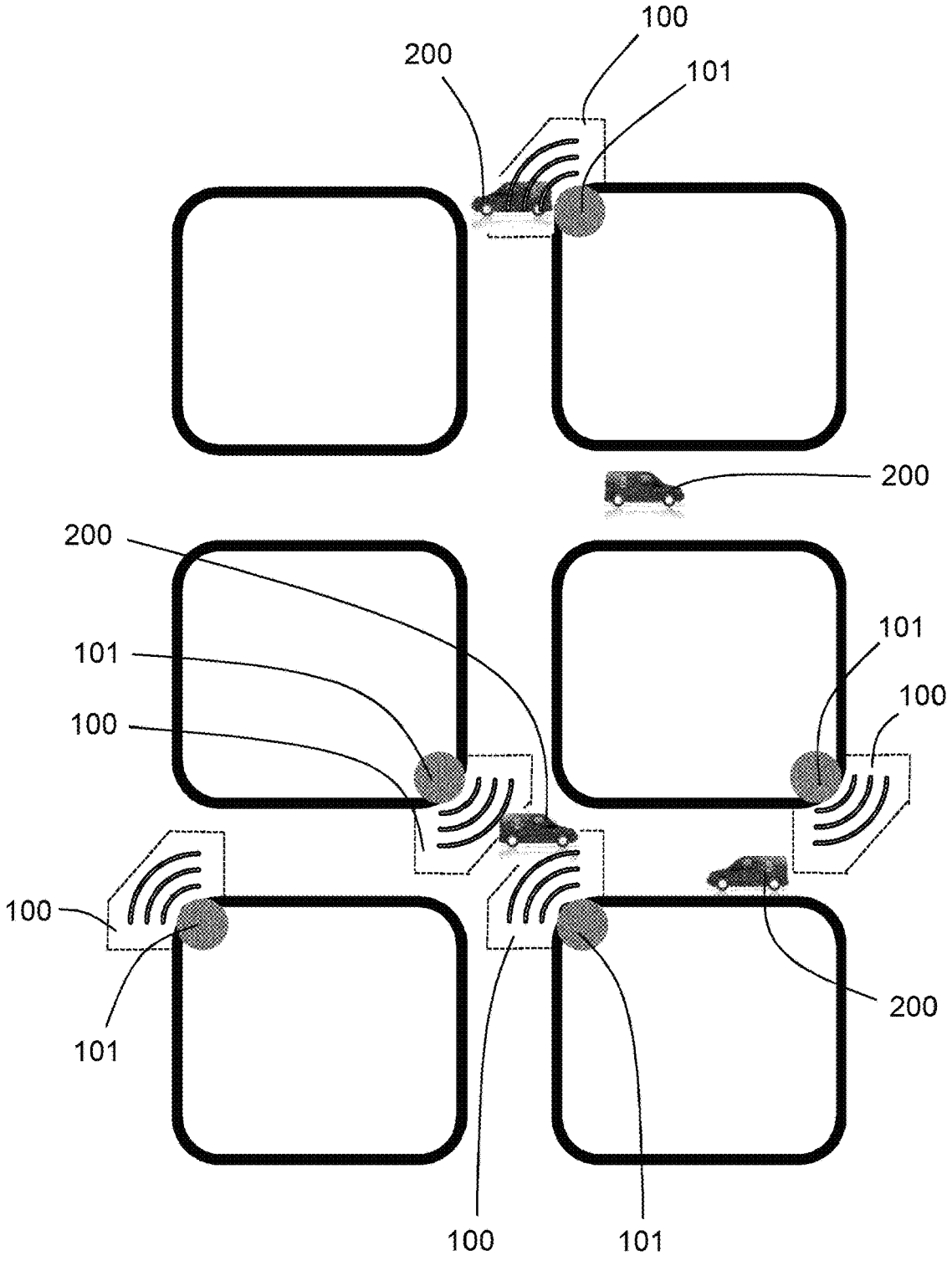
FIG. 1 shows a diagrammatic representation of an embodiment of the invention, wherein an urban environment with various parking zones is shown, each with a beacon device, and wherein various vehicles take part.
Figure 2:
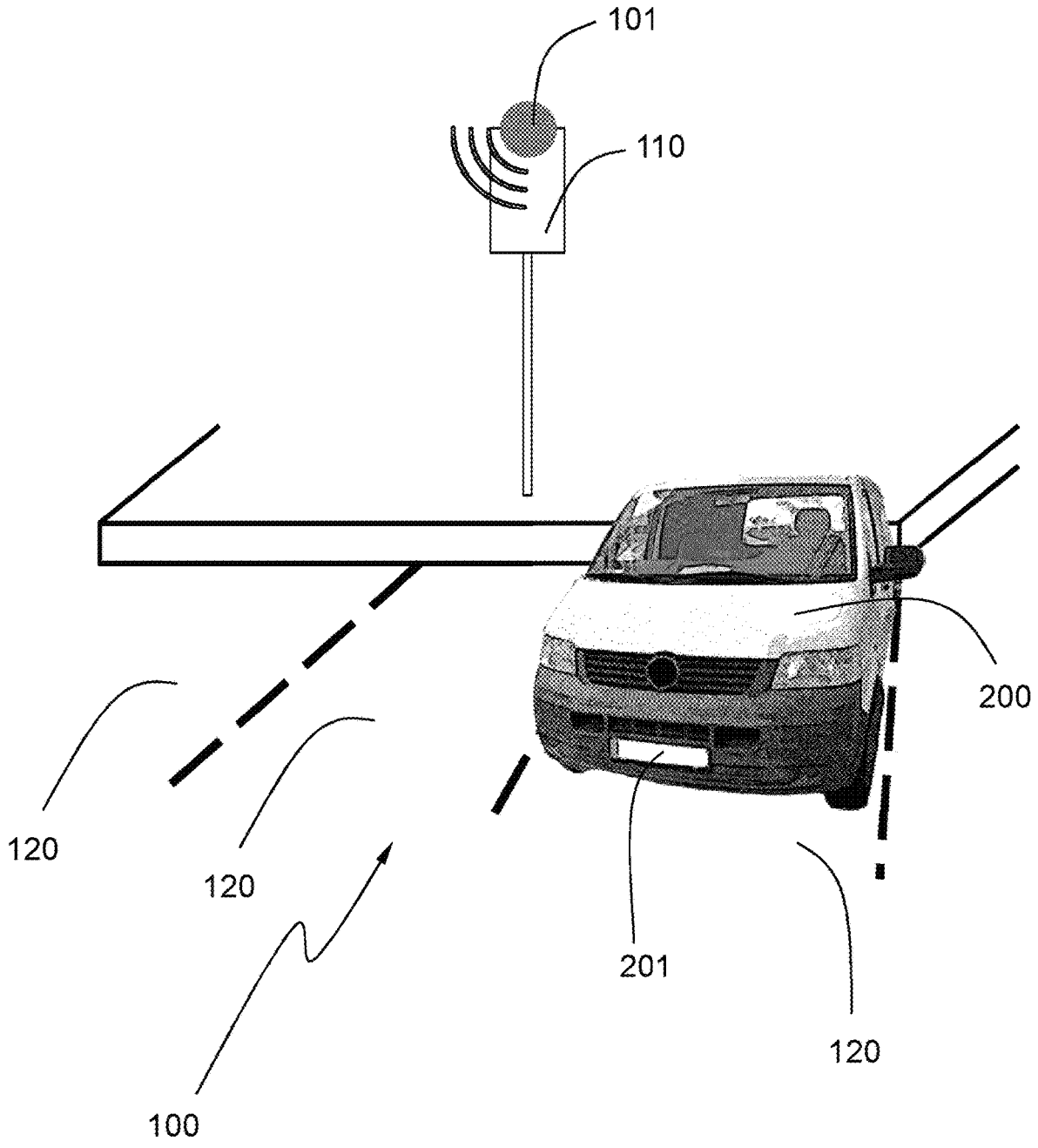
FIG. 2 shows a diagrammatic representation of one of the parking zones according to an embodiment of the invention.
Figure 3:
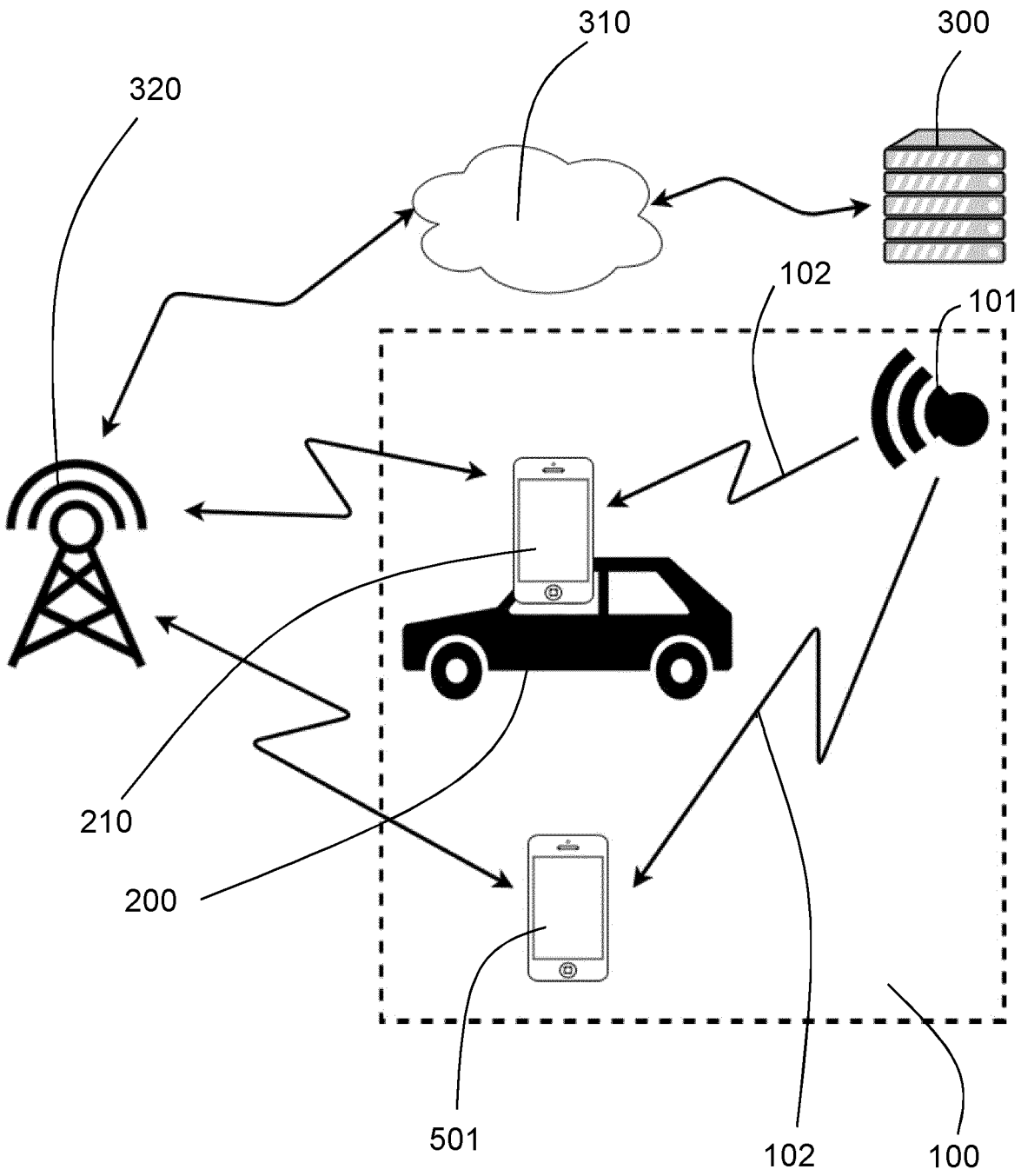
FIG. 3 shows a diagrammatic representation of the different elements involved in the embodiment of the invention.

FIGS. 1, 2 and 3 show schematic examples for the system. For the sake of clarity, the different involved elements have been represented through corresponding graphical elements. However, the different parts in the drawings should not be understood as representing physical elements with real shapes, nor the different elements are drawn to scale.

Therefore, the figures show an embodiment of the parking control method according to the invention, for at least one outdoor parking zone 100. Each parking zone 100 comprises one or more parking spaces 120, or it can be a parking zone without markings of spaces. In the example, the operation for loading and unloading zones which are common in towns for use by hauliers is described. However, it is a non-limiting example and the invention is not restricted to only such parking zones 100, but it is applicable to a different type of zones wherein there is a parking time restriction. Further possible non-restrictive uses are, for example, the so-called orange zones in which resident vehicles are allowed to park for a limited time, or the so-called red zones in which both residents and non-residents are allowed to park for a limited time.

In each zone of said at least one parking zone 100 a beacon device 101 is provided and configured for sending out a beacon signal 102, although if the parking zone 100 is very large, more than one beacon device 101 can be provided for a parking zone 100. All the examples herein described utilize beacon devices 101 which broadcast Bluetooth low energy, BLE, signals, and which emit at the same power. In particular, they are devices which transmit simultaneously according to the standards dictated by the trade names iBeacon and Eddystone. Those skilled in the art will understand that this is a particular implementation which is advantageous in relation with the state of the art at the time this document was written. However, it is a non-restrictive option and other technology types which are equivalent regarding the general functionality can be provided without falling thereby beyond the scope of the main claim. The beacon signal 102 comprises a unique beacon code, which is not repeated in the system. In the example, said beacon code comprises the media access control, MAC, address for the beacon device 101, i.e., the MAC address associated with the Bluetooth transmission. Also, the Bluetooth transmitted name of the beacon device 101 is chosen in such a way that it can be identified that said beacon device 101 pertains to the system. Thus, it is possible to use the system even through receiving devices supporting Bluetooth but not including iBeacon and Eddystone. Nevertheless, in order to provide an extra verification level, the beacon signal 102 in the example also includes a programmable identifying code, which comprises a start sequence identifying that the beacon device 101 pertains to the system, as well as the serial number for the beacon device 101, the date of manufacture thereof and an expected expiry date.

In FIG. 2, a schematic example of the parking zone 100 is shown. This zone comprises different parking spaces 120, and by way example, a vehicle 200 parked in one of said parking spaces 120 is shown. FIG. 2 shows that said parking zone 100 has an informative sign 110 as well. The beacon device 101 provided in said parking zone 100 is provided in said informative sign 110. The informative sign 110 is manufactured from metal and is attached to a post, displaying information about the parking conditions in said parking zone 100. Although not shown in FIG. 2, the informative sign 110 in the example is provided with a sealed case, in particular with at least a sealing degree IP56 according to the IEC 60529 standard, and more particularly with a sealing degree IP67. Said sealed case is removably attached to said informative sign 110 through attaching means, particularly on the upper rear portion of said informative sign 110. Said beacon device 101 is provided in said sealed case in the example.

FIG. 3 shows how a server 300 takes also part in the method, and the same comprises hosted computing services of the type known in the art as cloud computing such as, Software as a Service (SaaS), Platform as a Service (PaaS) or Infrastructure as a Service (IaaS). In the example, the server 300 has a back-office software for management and maintenance of the system, including functionalities such as configuring the beacon position and their associated zones, maintaining user profiles, incidence and alarm management, among further possible functionalities. In FIG. 3, the server 300 is shown connected to the Internet 310, such that a connection with said server 300 can be established from any device allowing for said connection. In particular, from a mobile telephone cellular data network 320.

In the method, at least one vehicle 200 also takes part, which moves together with a user across the environment where said at least one parking zone 100 is located. Moreover, for each vehicle 200 of said at least one vehicle 200, a portable user device 200 takes part, corresponding to said vehicle 200 and moving together with said vehicle 200. In the embodiment examples, it will be assumed that the portable user device 210 is a mobile phone of the so-called smart phone type, since such devices are widely utilized at the moment this document is being written, resulting in an advantageous election for the users. However, different types of equivalent devices are possible, with non-limiting examples being smart cars, or devices specifically made to carry out the described method. In either case, said portable user device 210 is provided with:

- Processing means, in the example, the mobile phone microprocessor.
- A user interface, in the most common examples: a touch screen, a physical or virtual keyboard, loudspeakers, microphone, and vibration warning system.
- Beacon signal receiving means, which, for these examples, comprises at least one Bluetooth receiver, and preferably implements one of the iBeacon or Eddystone protocols.
- Wireless communication means, which, in the example, comprises a telephone data network 320, for example, 3G or 4G. This allows the server 300 to be connected through the Internet 310.
- A unique vehicle code 201, associated with said vehicle 200, in particular, corresponding with said vehicle plate number, as shown in FIG. 2.

Figure 7:
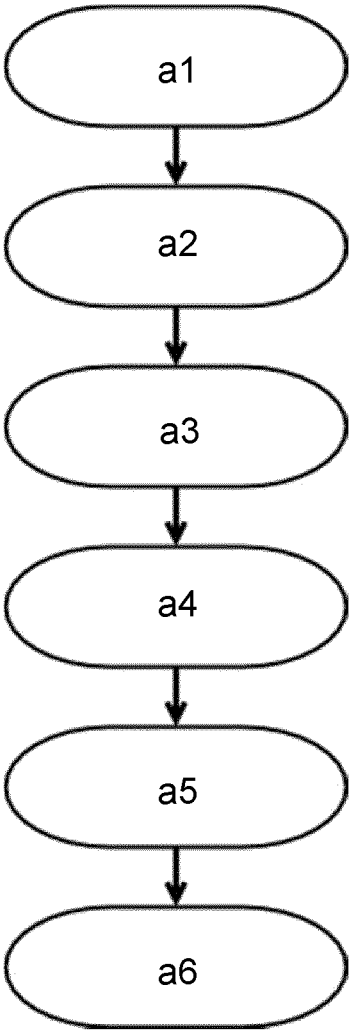
FIG. 7 shows a simplified flow chart for the computer program operation according to an embodiment example.

In the example, said vehicle code 201 is stored in the portable user device 210 in a previous method step. Thus, at first the user installs a computer program suitable for his/her device. Said computer program comprises program code instructions which, upon being executed by the portable user device 210, perform operations carrying out the method now described, in particular, that part of the method executed by the portable user device 210, as shown in FIG. 7. In the context corresponding to the smart phone example, these computer programs are often referred to as applications, for which reason both designations will be used herein. The user now utilizes said computer program to log into the system, and thus a user code is established. In this configuration phase, the user registers at least one vehicle, entering its plate number among other data, such as the type of vehicle 200, consumption thereof and features. In some preferred examples, the user also enters a picture of the vehicle. Said application sends the data to the server 300 where they are stored and used for determining the parking conditions for each vehicle 200, for example, based on the pollutant emission rate thereof. In the example of FIG. 2, the informative sign 110 also denotes the application to be used by the user, for example, through the application name and its identifying icon, a QR code with the download information, etc.

Figure 4:
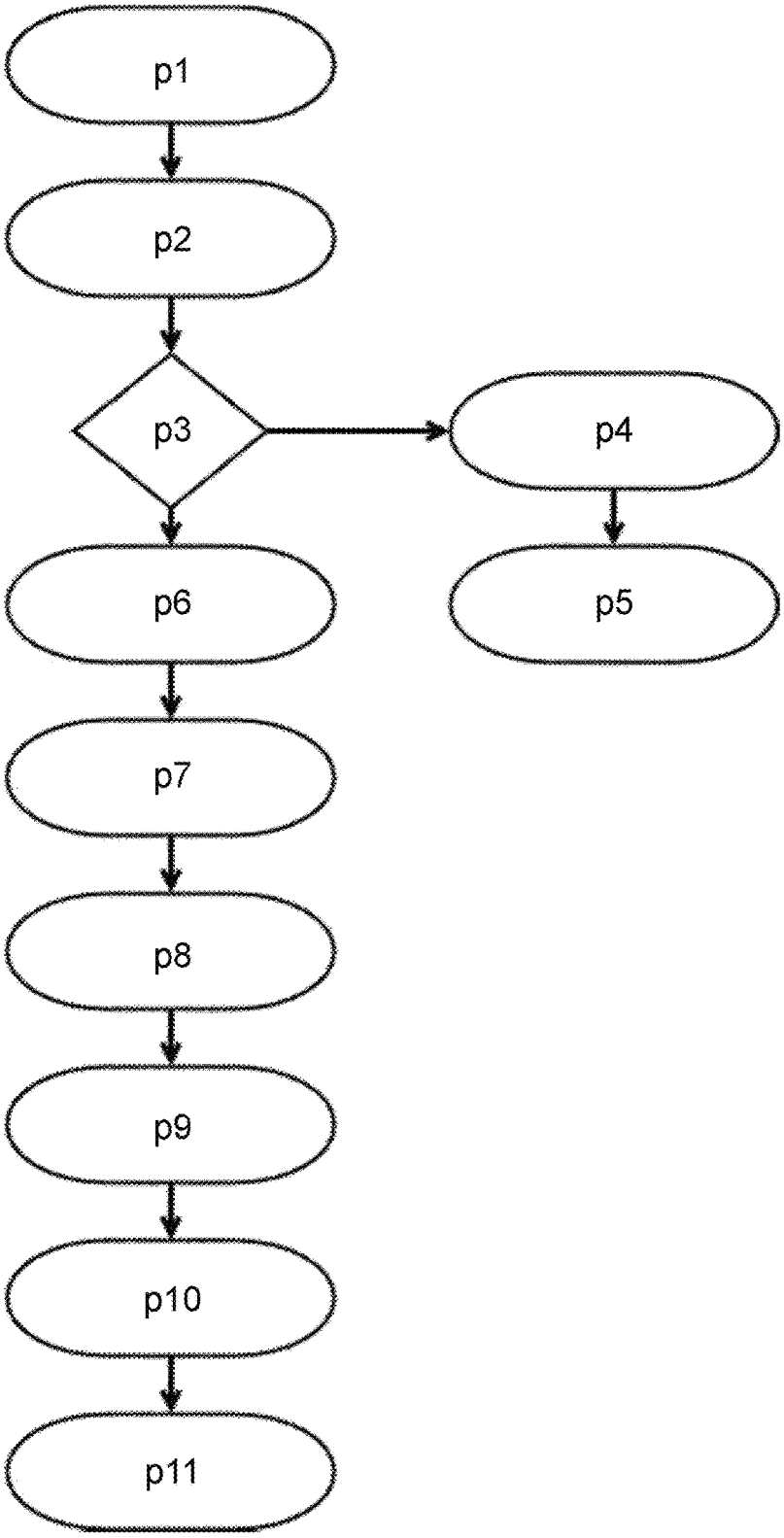
FIG. 4 shows a simplified flow chart of a method according to the invention.

In FIG. 4, a simplified flow chart of the example method is shown comprising the steps described below. In a step p1, by a portable user device 210 which moves together with a vehicle 200 and with a vehicle code 201, determining a parking start for a parking zone 100 with a beacon code. Particularly, in the embodiment example, this step comprises either a parking start commanded by the user or an automatic parking start. Said parking start instructed by the user comprises the following steps:

- Receiving through said user interface a parking start command.
- Receiving by said beacon signal receiving means, a beacon code list.
- Determining a closest beacon code as the beacon code of said beacon code list whose beacon device 101 is the closest one. Particularly, through the following steps:
  - receiving each beacon code of said beacon code list through a corresponding beacon signal 102 having a receiving power; and
  - determining the closest beacon code as the beacon code whose beacon signal 102 has the highest receiving power.
- Informing through said user interface of the parking zone 100 corresponding to said closest beacon code;
- Receiving through said user interface an election of a parking zone 100; and
- Determining said parking start for said received parking zone 100.

Said automatic parking start comprises the following steps:

- Determining when said beacon signal receiving means start detecting a beacon signal 102 with a beacon code of a beacon device 101. Particularly, in the example, detecting a beacon signal 102 comprises receiving said beacon signal 102 meeting a validation criterion, such that, in a case that said criterion is not met, it is not deemed detected. In the example, said validation criterion comprises a minimum receiving power threshold for said beacon signal 102, in particular −100 dBm. Additionally, for the embodiment examples herein described, the validation criterion also comprises verifying that the name of the beacon device 101 corresponds to a system name, and, in a case that the portable user device 210 supports the iBeacon or Eddystone protocols, also checking the format of the programmable identifying code transmitted in said protocols.
- Determining whether said receiving means detect said beacon signal 102 with said beacon code during a time window longer than a start threshold time.
- In the affirmative, in the example, additionally requesting confirmation through said user interface.
- In the affirmative, determining said parking start for a parking zone 100 associated with said beacon code.

In a step p2, by said communication means of said portable user device 210, sending to said server 300 a parking request 401 comprising said vehicle code 201 and said beacon code. For this example, said parking request 401 also comprises a user code.

In a step p3, by said server 300, determining whether said parking request 401 is acceptable. In a step p4, if said parking request 401 is not acceptable, by said server 300, sending a parking request reply 402 comprising an indication that said parking request 401 is not acceptable. In a step p5, by said portable user device 210, informing through said user interface, that said request is not acceptable.

In a step p6, if said parking request 401 is acceptable, further determining, by said server 300, a maximum parking time and sending a parking request reply 402 comprising an indication that said parking request 401 is acceptable and said maximum parking time.

In a step p7, by said portable user device 210:

Informing, through said user interface, that said request is acceptable and said maximum parking time.

Requesting a parking start confirmation through said user interface.

If said parking start confirmation is received, sending a parking start request 403 to said server 300.

In a step p8, by said server 300, registering said vehicle code 201 as parked in said parking zone 100 corresponding to said beacon code and a parking start time for said vehicle code 201, and determining said parking zone 100 as a current parking zone 100.

Thus, when the starting situation for a vehicle 200 is being parked in a current parking zone 100, the method part in charge of finishing the parking can start. For this example, while parked, the application of the portable user device 210 provides instructions relative to either the remaining parking time, or the exceeded time in case said maximum time has been surpassed. In particular, by means of text and a colour code, the application signals whether the maximum time is being reached or has been surpassed. The application may also use the acoustic or notification means, in order to warn the user.

In a step p9, the method also comprises thereby, by said portable user device 210, determining a parking end for said current parking zone 100. Particularly, in the example, it comprises either receiving, through said user interface, a parking end command, or the following steps:

Determining when said portable user device 210 is located at a distance from said current parking zone 100 greater than a threshold distance. In particular, through the following steps:

Determining when said beacon signal receiving means start detecting another beacon signal 102 with another beacon code of another beacon device 101.

Determining whether said another beacon device 101 meets a remoteness criterion with respect to said current parking zone 100. In the example, said remoteness criterion comprises verifying that said another beacon code is not included in a list of near codes, although, in further examples, said criterion comprises verifying that said another beacon code is included in a list of distant codes.

In the affirmative, i.e., if the remoteness criterion is met, determining that said portable user device 210 is located at a distance from said parking zone 100 which is greater than said threshold distance.

In the affirmative, in the example, said portable user device 210 additionally requests a parking end confirmation through said user interface.

in the affirmative, determining said parking end for said current parking zone 100.

In a step p10, by said communication means of said portable user device 210, sending to said server 300 a parking end request 404 comprising said vehicle code 201. In a step p11, by said server 300, registering said vehicle code 201 as not parked.

Figure 5:
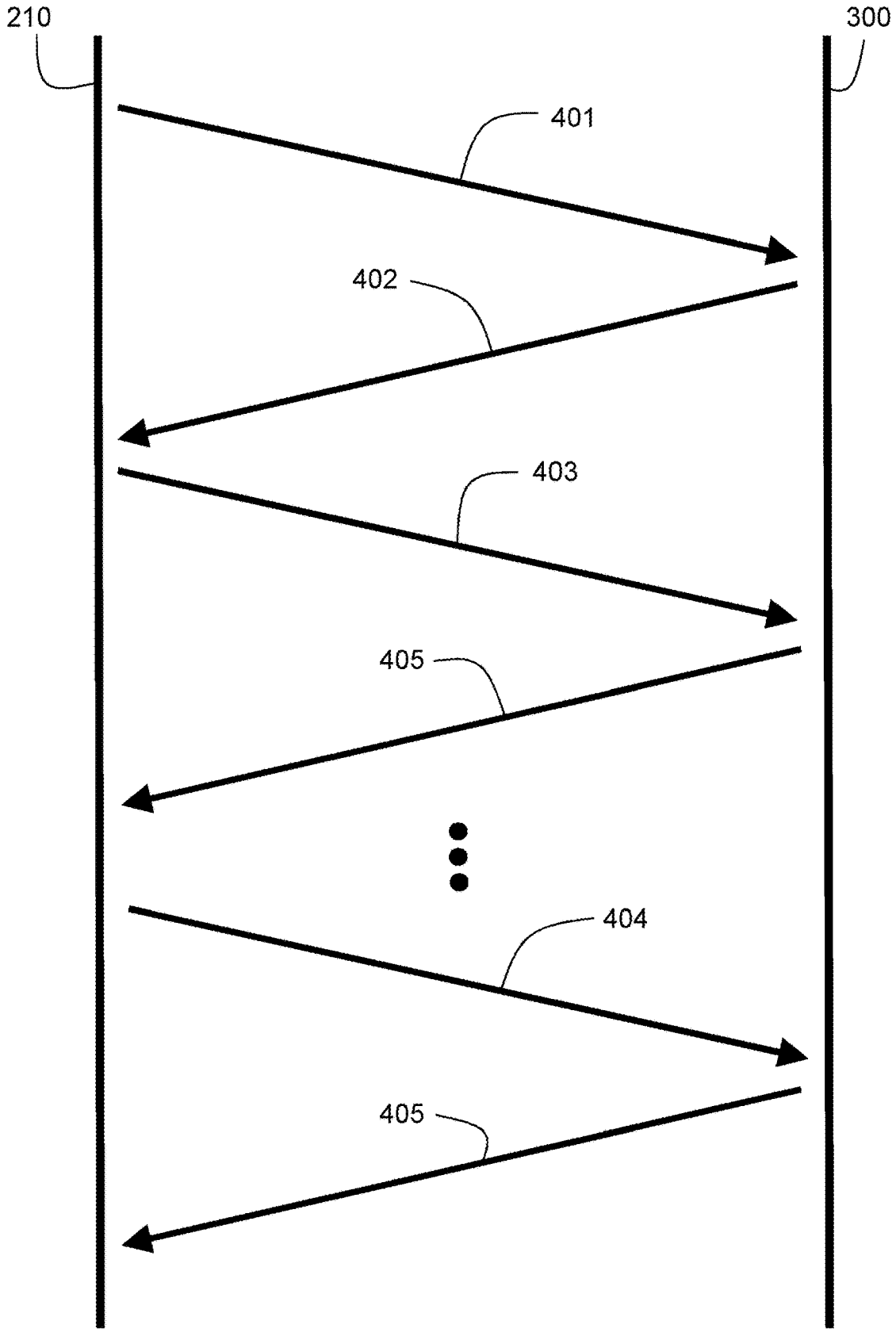
FIG. 5 shows a simplified flow of messages between a portable user device and the server, according to an embodiment of the method.

For the sake of brevity, the method for the portable user device 210 is not described separately, being carried out by a computer program which is executed in said portable user device 210. The person skilled in the art will not have any problems distinguishing actions by said device, considering what was previously described, as well as the flow chart in FIG. 7 and the action and message flow as described in FIG. 5. It can be seen in this figure how some of the requests from the portable user device 210 receive an acknowledgement message 405 from the server. In the example embodiment, there is a correspondence between the steps shown in FIG. 7 and those shown in FIG. 4. In the example, steps a1, a2, a5 and a6 in FIG. 7 thus correspond with steps p1, p2, p9 and p10 in FIG. 4, respectively. Also, step a3 in FIG. 7 corresponds with the reception of information sent by the server 300 in steps p4 and p6 of FIG. 7. Finally, step a4 corresponds with p5 and p7.

Figure 6:
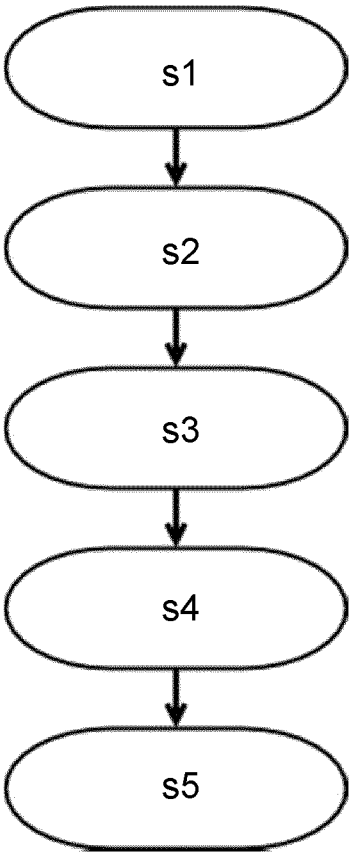
FIG. 6 shows a simplified flow chart referring to the supervision functionality in accordance with an embodiment example.

In addition to the above described method, the invention also facilitates the supervision of the one or more parking zones 100 by a supervisor. In FIG. 6, a simplified flow chart for that part of the method corresponding to said supervision is shown. Thus, at least a supervisor also takes part and the same is provided with a portable supervisor device 501 provided with processing means, a user interface, beacon signal receiving means, and wireless communication means. In particular, it is assumed in the example that the portable supervisor device 501 comprises a mobile phone of the so-called smart phone type, for the same reasons as those previously described for the portable user device 210. Likewise, the portable supervisor device 501 has an application stored therein which executes that part of the method corresponding to said portable supervisor device 501. The application of the example is different from that executed in the portable user device 210.

Thus, the method comprises the following further steps:

s1 By a portable supervisor device 501, determining a parking zone 100 with a beacon code. In particular through any of the following options:

Receiving, through said user interface, a parking zone selection command 100. That is, as triggered by the supervisor.

Determining a parking zone 100 whose beacon device 101 is located closest to the portable supervisor device 501. That is, automatically when the supervisor is located close to a beacon 101.

s2 By said communication means of said portable supervisor device 501, sending to said server 300 an information request comprising said beacon code.

s3 By said server 300, determining vehicle codes 201 corresponding to vehicles 200 registered as parked in said parking zone 100, and, for each one of said registered vehicle codes 201, determining a remaining parking time or an exceeded parking time.

s4 By said server 300, sending to said communication means of portable supervisor device 501 a reply to an information request, comprising an information list with said vehicle codes 201 and, for each one of said vehicle codes 201, said remaining parking time or said exceeded parking time.

s5 By said portable supervisor device 501, informing of said information list through said user interface.

In the example, the vehicle code 201 comprises the plate number of said vehicle 200, the supervisor being thus able to associate the screen information with that which can be seen in the parked vehicles 200 in a simple way. Likewise, in a case where a picture of the vehicle 200 is available, verification is even easier.

Hereinafter, further embodiments of the invention will be shown, which share many of the characteristics as described in the above paragraphs. Accordingly, only distinguishing elements will be described hereinafter, while, for the common elements, reference is made to the first embodiment description.

In further embodiments, said beacon device 101 is provided in an internal housing provided in said informative sign 110. Particularly, on the upper rear portion of said informative sign 110. Also, said internal housing has orifices arranged to allow said beacon signal 102 to be outputted.

In another embodiment example, determining when said portable user device 210 is located at a distance from said current parking zone 100 greater than a threshold distance comprises:

Determining a location for said beacon device 101 of said current parking zone 100.

Determining a location for said portable user device 210, preferably through a geolocation means provided in said portable user device 210.

Determining a separation distance between said location of said beacon

Determining whether said separation distance is greater than said threshold distance.

In further examples, said remoteness criterion comprises verifying that said another beacon code is included in a list of distant codes. That is, when the device detects a beacon code which is in a list of distant codes, the remoteness criterion is met, and the portable user device 210 determines that it is distant from the current parking zone 100.

The embodiments so far described represent non-limiting examples, such that the person skilled in the art will understand that multiple possible combinations among the claimed characteristics are possible, beyond those examples shown and within the scope of the invention.

The invention claimed is:

1. Parking control method for at least one outdoor parking zone, each parking zone having space for parking one or more vehicles, wherein, in each zone of said at least one parking zone, it is provided a beacon device configured to broadcast a beacon signal comprising a unique beacon code, and wherein the following also take part:

a server;

at least one vehicle; and for each vehicle of said at least one vehicle, a portable user device corresponding to said vehicle and which moves together with said vehicle, said portable user device being provided with:

processing means;

a user interface;

beacon signal receiving means;

wireless communication means; and a unique vehicle code, associated with said vehicle;

wherein the method comprises the following steps:

(p1) by said portable user device which moves together with said vehicle and with said unique vehicle code, determining a parking start for said at least one parking zone with said unique beacon code;

(p2) by said communication means of said portable user device, sending to said server a parking request comprising said unique vehicle code, and said unique beacon code;

(p3) by said server, determining whether said parking request is acceptable;

(p4) if said parking request is not acceptable, by said server, sending a first parking request reply comprising an indication that said parking request is not acceptable;

(p5) by said portable user device, informing through said user interface, that said parking request is not acceptable;

(p6) if said parking request is acceptable, by said server, further determining a maximum parking time and sending a second parking request reply comprising an indication that said parking request is acceptable and said maximum parking time;

(p7) by said portable user device, informing, through said user interface, that said parking request is acceptable and said maximum parking time;

(p8) by said server, registering said unique vehicle code as parked in said parking zone corresponding to said unique beacon code and a parking start time for said unique vehicle code, and determining said parking zone as a current parking zone;

(p9) by said portable user device, determining a parking end for said current parking zone;

(p10) by said communication means of said portable user device, sending to said server a parking end request comprising said unique vehicle code; and (p11) by said server, registering said unique vehicle code as not parked, and wherein said step (p1) comprises the following steps:

receiving through said user interface a parking start command;

receiving by said beacon signal receiving means, a beacon code list;

determining a closest unique beacon code as the unique beacon code of said beacon code list whose beacon device is the closest one;

informing through said user interface of the parking zone corresponding to said closest unique beacon code;

receiving through said user interface a selection of the parking zone; and determining said parking start for said received parking zone.

2. Method according claim 1, wherein said parking request further comprises a user code.

3. Method according to claim 1, further comprising between said steps (p7) and (p8) the following additional steps:

by said portable user device, requesting a parking start confirmation through said user interface;

if said parking start confirmation is received, sending to said server a parking start request.

4. Method according to claim 1, wherein said step for determining a closest beacon code as the unique beacon code of said beacon code list whose beacon device is the closest one comprises:

receiving each unique beacon code of said beacon code list through a corresponding beacon signal having a receiving power; and determining the closest beacon code as the unique beacon code whose beacon signal has the highest receiving power.

5. Method according to claim 1, wherein determining a distance between said portable user device and said beacon device is carried out by said portable user device from a received power of said beacon signal in said portable user device.

6. Method according to claim 1, wherein said step (p9) comprises the following steps:

determining when said portable user device is located at a first distance from said current parking zone greater than a threshold distance; and in the affirmative, determining said parking end for said current parking zone.

7. Method according to claim 6, wherein said step of determining said parking end for said current parking zone is done after requesting a parking end confirmation through said user interface.

8. Method according to claim 6, wherein determining when said portable user device is located at a first distance from said current parking zone greater than a threshold distance comprises:

determining when said beacon signal receiving means start detecting another beacon signal with another unique beacon code of another beacon device;

determining whether said another beacon device meets a remoteness criterion with respect to said current parking zone; and in the affirmative, determining that said first distance at which said portable user device is located from said current parking zone is greater than said threshold distance.

9. Method according to claim 8, wherein said remoteness criterion is selected from the group consisting of:

said another unique beacon code is not included in a white list of code beacons that are near codes; and said another unique beacon code is included in a black list of code beacons that are distant codes.

10. Method according to claim 1, wherein at least a supervisor also takes part and the supervisor is provided with a portable supervisor device provided with:

second processing means;

a second user interface;

second beacon signal receiving means; and second wireless communication means;

wherein the method comprises the following additional steps:

(s1) by said portable supervisor device, determining said parking zone with said unique beacon code;

(s2) by said second communication means of said portable supervisor device, sending to said server an information request comprising said unique beacon code;

(s3) by said server, determining unique vehicle codes corresponding to vehicles registered as parked in said parking zone, and, for each one of said registered unique vehicle codes, determining a remaining parking time or an exceeded parking time;

(s4) by said server, sending to said second wireless communication means of said portable supervisor device a reply to an information request, comprising an information list with said unique vehicle codes and, for each one of said unique vehicle codes, said remaining parking time or said exceeded parking time; and (s5) by said portable supervisor device, informing of said information list through said second user interface.

11. Method according to claim 10, wherein said step (s1), determining said parking zone, is done through one of the list consisting of:

receiving through said second user interface, a parking zone selection command; and determining said parking zone whose beacon device is located closest to the portable supervisor device.

12. Method according to claim 1, wherein each of said parking zones comprises an informative sign and said beacon device provided in said parking zone is provided on said informative sign.

13. Method according to claim 12, wherein said informative sign also displays how to use the method including how to access the method from said portable user device.

14. Method according to claim 12, wherein said beacon device is provided in an internal housing provided in said informative sign.

15. Method according to claim 14, wherein said internal housing is located in an upper rear portion of said informative sign.

16. Method according to claim 14, wherein said internal housing has orifices arranged to allow said beacon signal to be outputted.

17. Method according to claim 12, wherein said informative sign is provided with a sealed case, said sealed case being removably attached to said informative sign through attaching means.

18. Method according to claim 17, wherein said sealed case has at least a sealing degree IP56 according to the IEC 60529 standard.

19. Method according to claim 17, wherein said sealed case is removably attached to said informative sign on a rear portion of said informative sign.

20. Parking control method for at least one outdoor parking zone, each parking zone having space for parking one or more vehicles, wherein, in each zone of said at least one parking zone, it is provided a beacon device configured to broadcast a beacon signal comprising a unique beacon code, and wherein the following also take part:

a server;

at least one vehicle; and for each vehicle of said at least one vehicle, a portable user device corresponding to said vehicle and which moves together with said vehicle, said portable user device being provided with:

processing means;

a user interface;

beacon signal receiving means;

wireless communication means; and a unique vehicle code, associated with said vehicle;

wherein the method comprises the following steps:

(p1) by said portable user device which moves together with said vehicle and with said unique vehicle code, determining a parking start for said at least one parking zone with said unique beacon code;

(p2) by said communication means of said portable user device, sending to said server a parking request comprising said unique vehicle code, and said unique beacon code;

(p3) by said server, determining whether said parking request is acceptable;

(p4) if said parking request is not acceptable, by said server, sending a first parking request reply comprising an indication that said parking request is not acceptable;

(p5) by said portable user device, informing through said user interface, that said parking request is not acceptable;

(p6) if said parking request is acceptable, by said server, further determining a maximum parking time and sending a second parking request reply comprising an indication that said parking request is acceptable and said maximum parking time;

(p7) by said portable user device, informing, through said user interface, that said parking request is acceptable and said maximum parking time;

(p8) by said server, registering said unique vehicle code as parked in said parking zone corresponding to said unique beacon code and a parking start time for said unique vehicle code, and determining said parking zone as a current parking zone;

(p9) by said portable user device, determining a parking end for said current parking zone;

(p10) by said communication means of said portable user device, sending to said server a parking end request comprising said unique vehicle code; and (p11) by said server, registering said unique vehicle code as not parked, and wherein said step (p1) comprises the following steps:

determining when said beacon signal receiving means start detecting said beacon signal with said unique beacon code of said beacon device;

determining whether said receiving means detect said beacon signal with said unique beacon code during a time window longer than a start threshold time; and in the affirmative, determining said parking start for said parking zone associated with said unique beacon code.

21. Method according to claim 20, wherein said step of determining said parking start for said parking zone associated with said unique beacon code is done after requesting confirmation through said user interface.

22. A non-transitory machine-readable medium having a computer program code recorded thereon, the computer program code when executed by a portable user device which moves together with a vehicle, said portable user device comprising:

processing means;

a user interface;

beacon signal receiving means, configured for receiving beacon signals containing unique beacon codes, from beacon devices provided in outdoor parking zones, each parking zone having space for parking one or more vehicles;

wireless communication means, configured for establishing a communication with a server; and a unique vehicle code, associated with said vehicle, performs the following method:

(a1) determining a parking start for a first parking zone with a unique beacon code;

(a2) by said communication means, sending to said server a parking request comprising said unique vehicle code, and one of said unique beacon codes;

(a3) by said communication means, receiving an indication indicating whether said parking request is acceptable, and in the affirmative, receiving a maximum parking time;

(a4) informing, through said user interface, about whether said parking request is acceptable and, in the affirmative, about said maximum parking time, and determining said first parking zone as a current parking zone;

(a5) by said portable user device, determining a parking end for said current parking zone; and (a6) by said communication means of said portable user device, sending to said server a parking end request comprising said unique vehicle code, wherein said step (a1) comprises the following steps:

receiving through said user interface a parking start command;

receiving by said beacon signal receiving means, a beacon code list;

determining a closest beacon code as the unique beacon code of said beacon code list whose beacon device is the closest one;

informing through said user interface of the parking zone corresponding to said closest beacon code;

receiving through said user interface a selection of the first parking zone; and determining said parking start for said received first parking zone.

23. The non-transitory machine-readable medium according to claim 22, wherein said parking request further comprises a user code.

24. The non-transitory machine-readable medium according to claim 22, wherein said step (a5) comprises the following steps:

determining when said portable user device is located at a first distance from said current parking zone greater than a threshold distance; and in the affirmative, determining said parking end for said current parking zone.

25. The non-transitory machine-readable medium according to claim 24, wherein determining when said portable user device is located at a first distance from said current parking zone greater than a threshold distance comprises:

determining when said beacon signal receiving means start detecting another beacon signal with another unique beacon code of another beacon device;

determining whether said another beacon device meets a remoteness criterion with respect to said current parking zone; and in the affirmative, determining that said first distance at which said portable user device is located from said current parking zone is greater than said threshold distance.

26. The non-transitory machine-readable medium according to claim 25, wherein said remoteness criterion is selected from the group consisting of:

said another unique beacon code is not included in a white list of code beacons that are near codes; and said another unique beacon code is included in a black list of code beacons that are distant codes.

27. The non-transitory machine-readable medium according to claim 22, wherein said step of determining said parking end for said current parking zone is done after requesting confirmation through said user interface.

28. The non-transitory machine-readable medium according to claim 22, wherein the method further comprises the following additional steps when the parking request is acceptable:

requesting a parking start confirmation through said user interface;

if said parking start confirmation is received, sending to said server a parking start request.

29. The non-transitory machine-readable medium according to claim 22, wherein said step for determining the closest beacon code as the unique beacon code of said beacon code list whose beacon device is the closest one comprises:

receiving each unique beacon code of said beacon code list through a corresponding beacon signal having a receiving power; and determining the closest beacon code as the unique beacon code whose beacon signal has the highest receiving power.

30. The non-transitory machine-readable medium according to claim 22, wherein determining a distance between said portable user device and said beacon device is carried out by said portable user device from a received power of said beacon signal in said portable user device.

31. A non-transitory machine-readable medium having a computer program code recorded thereon, the computer program code when executed by a portable user device which moves together with a vehicle, said portable user device comprising:

processing means;

a user interface;

beacon signal receiving means, configured for receiving beacon signals containing unique beacon codes, from beacon devices provided in outdoor parking zones, each parking zone having space for parking one or more vehicles, wireless communication means, configured for establishing a communication with a server; and a unique vehicle code, associated with said vehicle, performs the following method:

(a1) determining a parking start for a first parking zone with a unique beacon code;

(a2) by said communication means, sending to said server a parking request comprising said unique vehicle code, and one of said unique beacon codes;

(a3) by said communication means, receiving an indication indicating whether said parking request is acceptable, and in the affirmative, receiving a maximum parking time;

(a4) informing, through said user interface, about whether said parking request is acceptable and, in the affirmative, about said maximum parking time, and determining said first parking zone as a current parking zone;

(a5) by said portable user device, determining a parking end for said current parking zone; and (a6) by said communication means of said portable user device, sending to said server a parking end request comprising said unique vehicle code, wherein said step (a1) comprises the following steps:

determining when said beacon signal receiving means start detecting a first beacon signal with said unique beacon code of said beacon device;

determining whether said receiving means detect said first beacon signal with said unique beacon code during a time window longer than a start threshold time; and in the affirmative, determining said parking start for the first parking zone associated with said unique beacon code.

32. The non-transitory machine-readable medium according to claim 31, wherein said step of determining said parking start for a first parking zone is done after requesting confirmation through said user interface.

* * * * *